US008506158B2

(12) United States Patent
Keung et al.

(10) Patent No.: US 8,506,158 B2
(45) Date of Patent: Aug. 13, 2013

(54) WATCH

(75) Inventors: Paul So Wing Keung, Cheung Sha Wan (HK); Leung Chun Fai, Cheung Sha Wan (HK); Tam Wing Hong, Cheung Sha Wan (HK)

(73) Assignee: P.S.L. Limited (HK)

( * ) Notice: Subject to any disclaimer, the term of this patent is extended or adjusted under 35 U.S.C. 154(b) by 487 days.

(21) Appl. No.: 12/902,787

(22) Filed: Oct. 12, 2010

(65) Prior Publication Data

US 2012/0087216 A1 Apr. 12, 2012

(51) Int. Cl.
*G04B 37/00* (2006.01)
*A44C 5/00* (2006.01)

(52) U.S. Cl.
USPC ..... 368/282; 224/164

(58) Field of Classification Search
USPC ..... 368/281–282; 224/164, 176
See application file for complete search history.

(56) References Cited

U.S. PATENT DOCUMENTS

| | | | | |
|---|---|---|---|---|
| 6,220,916 | B1 | 4/2001 | Bart et al. | |
| D612,269 | S * | 3/2010 | Leung | D10/32 |
| 8,162,383 | B2 * | 4/2012 | Curtis | 296/180.4 |
| 2003/0155389 | A1 | 8/2003 | Swartzentruber | |
| 2008/0166519 | A1 * | 7/2008 | Leung | 428/120 |
| 2013/0044215 | A1 * | 2/2013 | Rothkopf et al. | 348/143 |

* cited by examiner

*Primary Examiner* — Vit W Miska
(74) *Attorney, Agent, or Firm* — Polsinelli PC

(57) ABSTRACT

A watch having a band formed from a bistable spring is described. The band automatically wraps to or coils around a wrist, arm, or other limb of an individual wearing the watch. The band is formed from the bistable spring, which includes an extended configuration and a coiled configuration. The band forms a first portion and a second portion. An outer layer covers at least a portion of the bistable spring. The watch includes a watch module to display time data. A housing receives the watch module. The housing is integral with the outer layer. The housing is positioned between the first portion and the second portion of the band.

20 Claims, 7 Drawing Sheets

WATCH

FIELD OF INVENTION

The present invention relates to a watch having a bistable spring in its band. The present invention further relates to a band for holding electronic devices.

BACKGROUND OF INVENTION

U.S. Patent Publication No. 2003/0155389 describes a slap on watch utilizing a bistable spring in the band. Separate portions of elastic material are used to attach a watch face to the band. The separate portions of elastic material attach to the band by fusing or using an adhesive.

U.S. Pat. No. 6,220,916 describes a toy band using a bistable spring in order to coil around a wrist of a wearer. A housing contains electrical components that may play a pre-recorded message. The housing has slots to attach to the band. Specifically, the band passes through the slots of the housing. The housing may be easily separated from the band and/or move relative to the band.

SUMMARY OF INVENTION

A watch having a band formed from a bistable spring is described. The band automatically wraps to or coils around a wrist, arm, or other limb of an individual wearing the watch. The band is formed from the bistable spring, which includes an extended configuration and a coiled configuration. The band may be positioned in the extended configuration by straightening out the band. The band may change to the coiled configuration by slapping or applying the band to the wrist, arm, or limb of the wearer. Such bands are commonly referred to as a "slap band", and may be applied to the wearer by slapping the band against the wrist.

The bistable spring maintains an elongate or generally straight position in the extended configuration. The bistable spring includes a concave upper surface that holds the band in the extended configuration. When a force is applied to the band that bends the band, the bistable spring changes to the coiled configuration in which ends of the band wrap or coil.

The band of the watch includes the bistable spring, which is at least partially covered with a layer of flexible or elastic material, such as silicone or other silicone-type material. As such, the bistable spring is not directly contacting the skin of the individual wearing the watch. Instead, the silicone layer is in direct contact with the skin. The silicone layer is soft to the touch and does not abrade the skin of the wearer. The bistable spring may also be fully covered by the silicone.

The band includes a watch module that displays a time reading. The watch module may be permanent, integral with, or removable relative to the watch band. The watch module may include a timing function or display a time readout or other time and date data. The band may also include other electronic modules or portable electronic devices, such as, for example, pedometers, MP3 players, GPS, etc. Optionally, the watch module may be removed and replaced with one of these other electronic modules.

The watch module or the electronic module/device is contained in a housing that is formed from or by the outer layer of the silicone material. The outer layer and the housing form an integral structure.

The watch may be attached or connected to the wearer by slapping the watch band against the wrist, arm, or other limb of the wearer. The opposite ends of the band wrap and/or coil around the individual's wrist, arm, or other limb. When it is desired to remove the watch, the individual unwraps or uncoils the ends of the band.

In a first aspect, a watch is described. The watch includes a band having a bistable spring. The band forms a first portion and a second portion. An outer layer covers at least a portion of the bistable spring. The watch includes a watch module to display time data. A housing receives the watch module. The housing is integral with the outer layer. The housing is positioned between the first portion and the second portion of the band.

In a further aspect, a band for a watch and/or electronic device is described. The band includes a bistable spring. The band forms a first portion and a second portion. An outer layer covers at least a portion of the bistable spring. A housing receives a watch module or the electronic device. The housing is integral with the outer layer. The housing is positioned between the first portion and the second portion of the band. The housing forms an upper cavity and a lower cavity. The upper cavity includes a deformable or resilient opening.

In a further aspect, a method of manufacturing a watch is described. The method includes providing a bistable spring. The method includes molding an outer layer and a housing around the bistable spring to cover at least a portion of the bistable spring, wherein the housing is integral with the outer layer, and the housing includes a cavity that receives a watch module. The method includes deforming an opening of the housing to insert the watch module into the cavity. The method includes inserting the watch module into the cavity of the housing.

In a further aspect, a method of manufacturing a watch band is described. The method includes providing a bistable spring. A length of the bistable spring is placed into a mold. The length of bistable spring is fastened to the mold by one or more fasteners that attach or connect to one or more holes in the bistable spring. Lengths of solid silicone are cast around the bistable spring to form the outer layer with the integral housing. The watch band is removed from the mold. In the alternative, liquid silicone may also be injected or poured into the mold to form the outer layer with the integral housing.

DETAILED DESCRIPTION OF INVENTION

A slap on watch having a band formed from a bistable spring is described. The band automatically wraps to or coils around a wrist, arm, or other limb of an individual wearing the watch. The band is formed from the bistable spring, which includes an extended configuration and a coiled configuration. The band forms a first portion and a second portion. An outer layer covers at least a portion of or all of the bistable spring. The watch includes a watch module to display time data. A housing removably receives the watch module. The housing is integral with the outer layer. The housing is positioned between the first portion and the second portion of the band. An opening of the housing deforms or expands to accommodate the insertion and removal of the watch module. The opening leads to a cavity in the housing that receives and holds the watch module.

Figure 1:
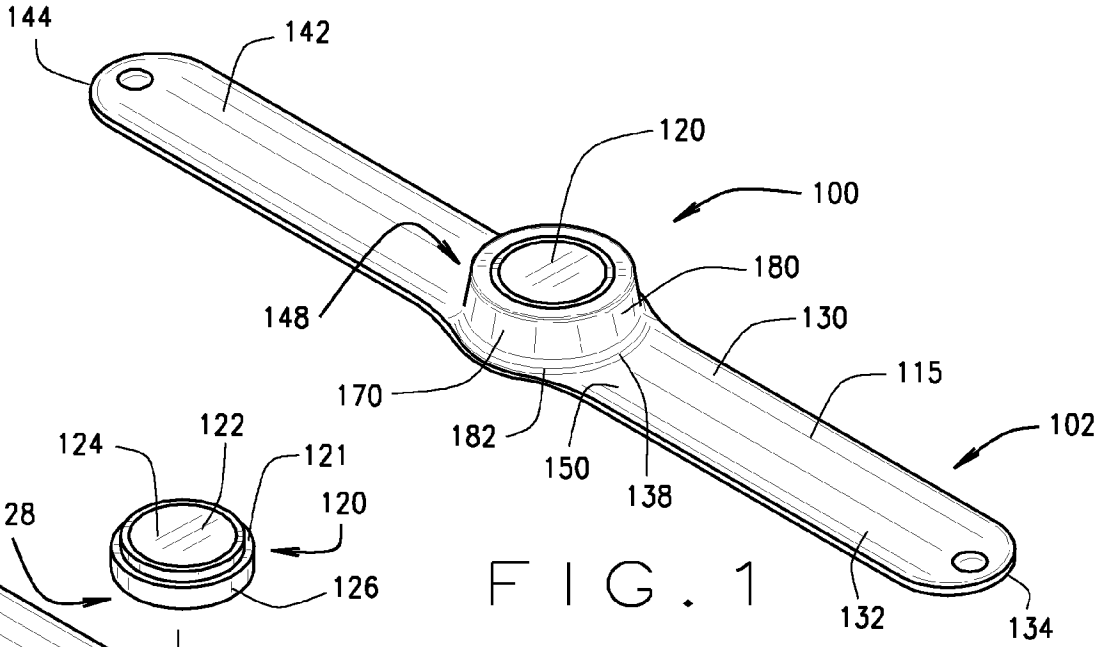
FIG. 1 is a perspective view of the first watch in the extended configuration.
Figure 2:
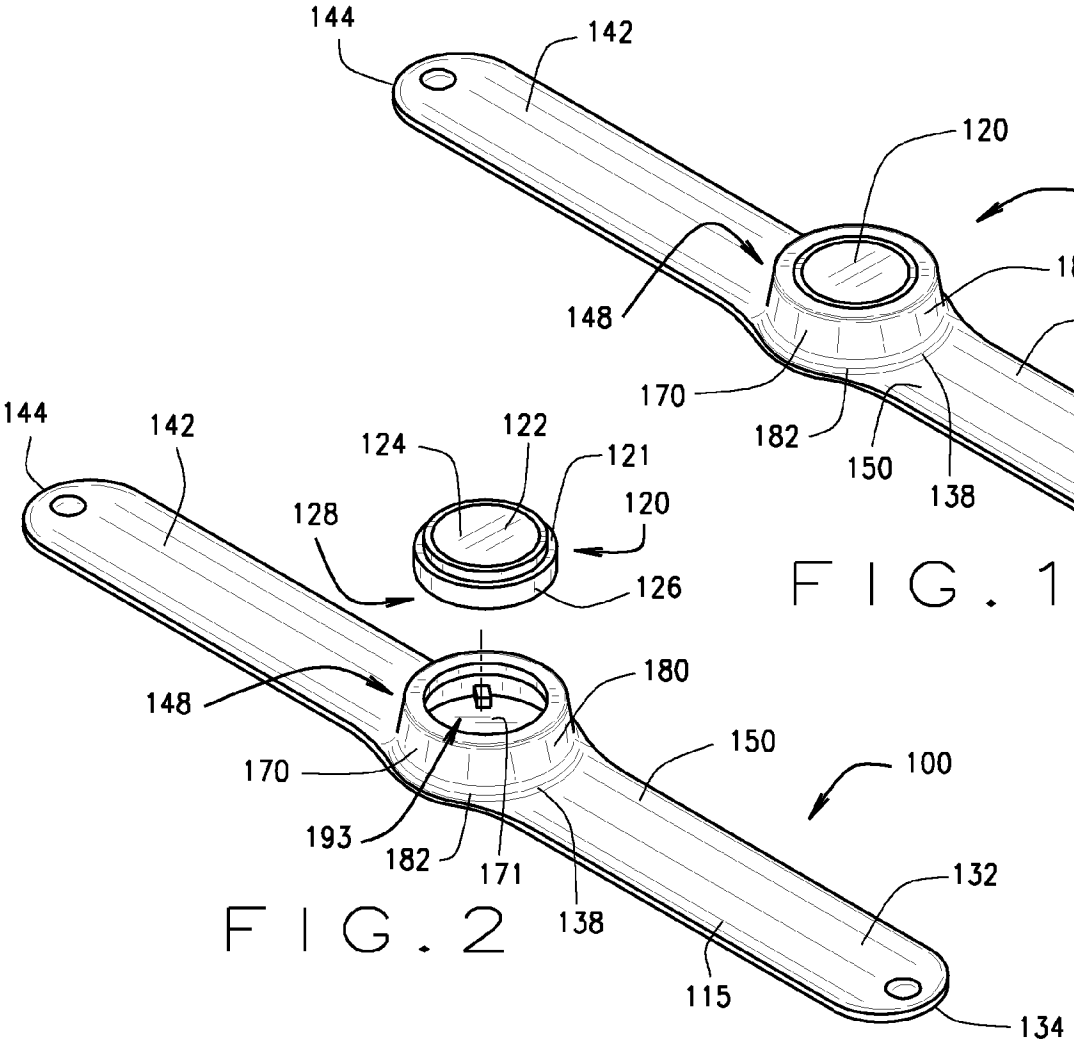
FIG. 2 is a perspective view of the first watch with the watch module removed.
Figure 3:
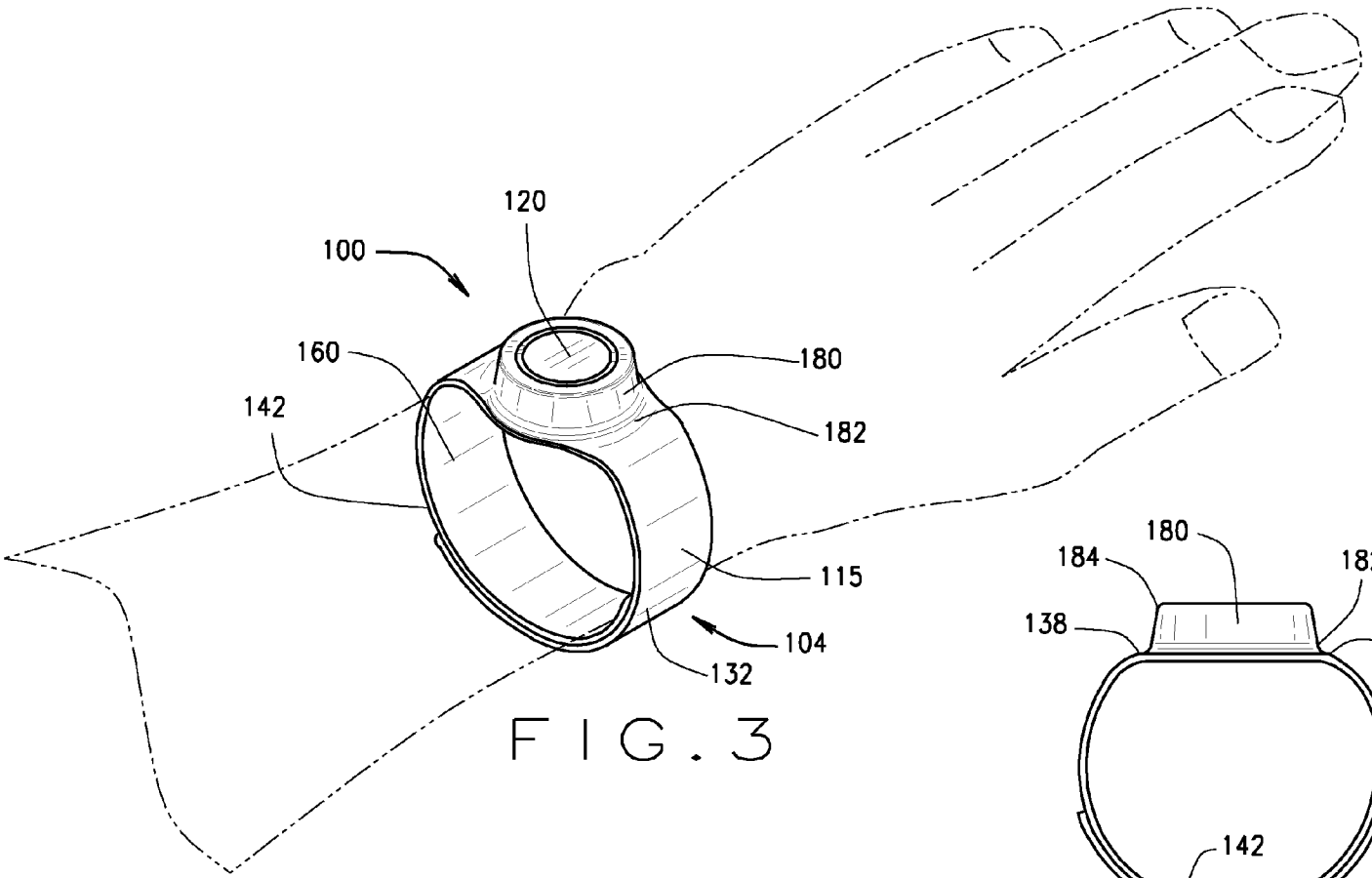
FIG. 3 is a view of the first watch in the coiled configuration.
Figure 4:
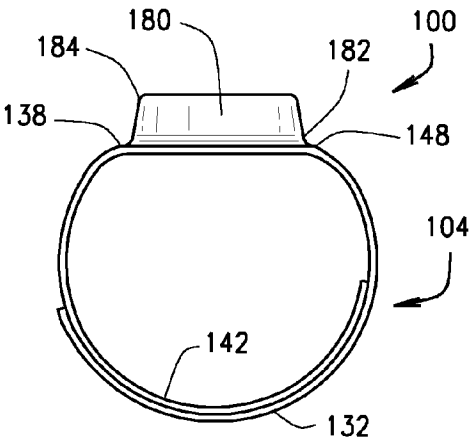
FIG. 4 is a side view of the first watch in the coiled configuration.
Figure 5:
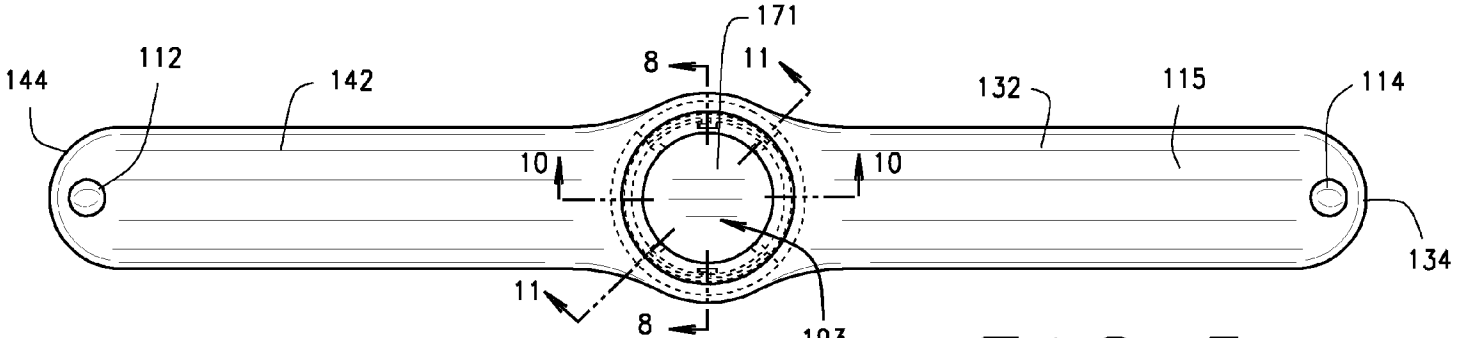
FIG. 5 is a top view of the first watch.
Figure 6:
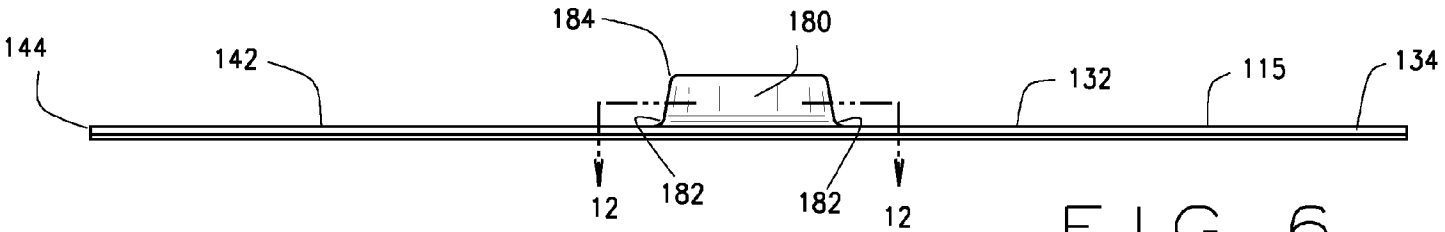
FIG. 6 is a side view of the first watch.

The slap on watch and a slap on watch band will now be described with reference to FIGS. 1-27. A first watch 100 is shown in FIG. 1. The first watch 100 includes an extended configuration 102 (shown in FIG. 1) and a coiled configuration 104 (shown in FIG. 4). The first watch 100 may repeatedly change or transform between the extended configuration 102 and the coiled configuration 104. In the coiled configuration 104, the first watch 100 wraps around or holds to the wrist, arm, or other limb of the wearer. The first watch 100 includes a bistable spring 110 that is at least partially or fully covered by an outer layer 115. The outer layer 115 may comprise silicone or other silicone-type materials.

The first watch 100 includes a band 130 and a watch module 120. The band 130 forms or defines a housing 170 that holds or receives the watch module 120.

The band 130 includes a first portion 132 on a first side of the watch module 120 and a second portion 142 on a second side of the watch module 120. The first portion 132 terminates in a first end 134, while the second portion 142 terminates in a second end 144.

The band 130 is formed by coating a length of the bistable spring 110 with the outer layer 115. For example, silicone may be molded around the bistable spring 110. Generally, a single length of bistable spring 110 will be used in forming the band 130.

The housing 170 is positioned between the first end 134 and the second end 144. The housing 170 extends from an upper surface 150 of the band 130. The housing 170 holds and receives the watch module 120. The watch module 120 includes an upper surface 122 with a time readout 124. The watch module 120 further includes lateral surfaces 126 and a bottom surface 128. The watch module 120 may include any of a variety of digital and/or analog time or timing instruments. The housing 170 may be positioned centrally between the first end 134 and the second end 144, or the housing 170 may positioned between a longer first end 134 and a second shorter end 144, and vice versa.

The upper surface 122 of the watch module 120 may include ornamental or design features. The watch module 120 may be removed from the housing 170 and replaced with a different watch module 120 depending upon the desired aesthetic appearance of the individual wearing the first watch 100. The watch module 120 may be removed in order to change batteries or adjust timing features of the watch module 120. Controls for the watch module 120 may also be included on the upper surface 122, the lateral surfaces 126, or the bottom surface 128.

The housing 170 is an integral structure formed by the outer layer 115. The housing 170 is formed above the upper surface 150 of the band 130. The housing 170 is formed of a deformable and resilient material that may stretch and contract in order to insert and retain the watch module 120. The housing forms an upper cavity 193 that receives the watch module 120. The housing 170 holds the watch module 120 in the upper cavity 193. The housing 170 defines an opening 171. The opening 171 is in open communication with the upper cavity 193. The opening 171 stretches or expands to receive the watch module 120. After insertion of the watch module 120, the opening 171 contracts to maintain the watch module 120 in the upper cavity 193.

The housing 170 includes a support member 190 within the housing 170. The support member 190 provides support and rigidity to the housing 170. The support member 190 may be made of a metal, such as stainless steel, or other plastic material. The support member 190 may have a generally circular, square, rectangular, or other geometric or irregular shape. The support member 190 may be embedded in the housing 170, or the outer layer 115 may be formed around the support member 190. The support member 190 may also be integral with the housing 170.

Figure 8:
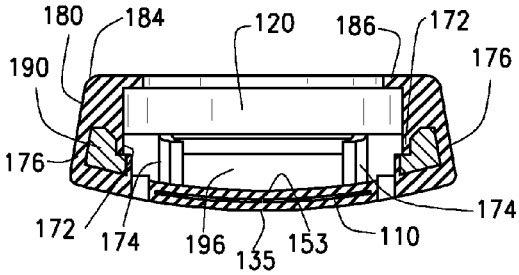
FIG. 8 is a sectional view of the first watch in the extended configuration.
Figure 9:
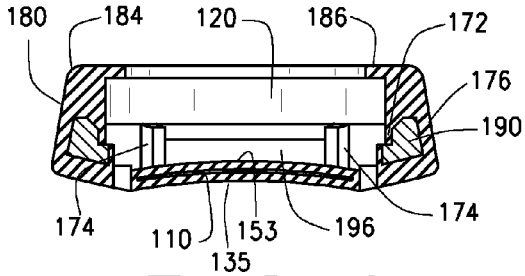
FIG. 9 is a sectional view of the first watch in the coiled configuration.
Figure 10:
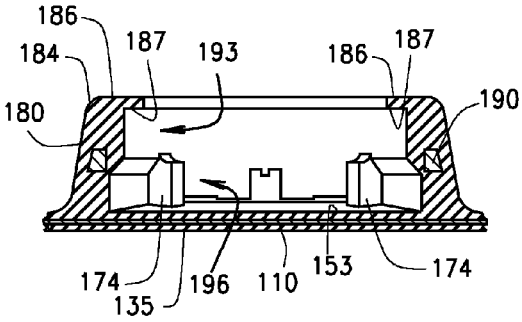
FIG. 10 is a sectional view of the first watch in the extended configuration.
Figure 11:
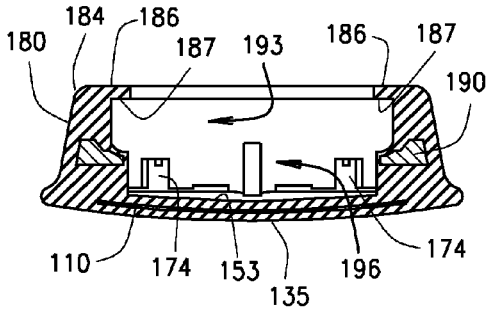
FIG. 11 is a sectional view of the first watch in the extended configuration.
Figure 12:
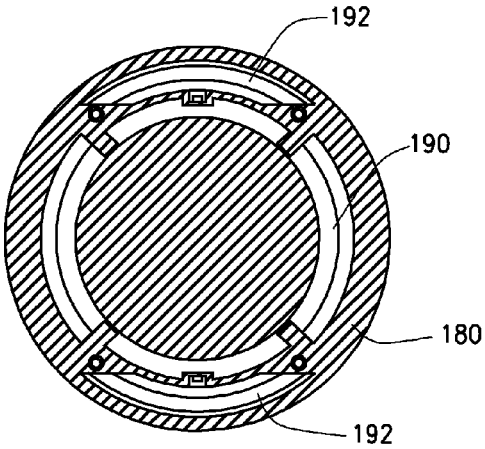
FIG. 12 is a sectional view of the first watch.
Figure 13:
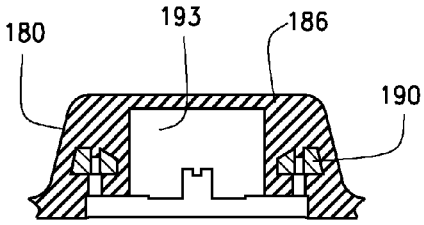
FIG. 13 is a sectional view of the first watch.
Figure 14:
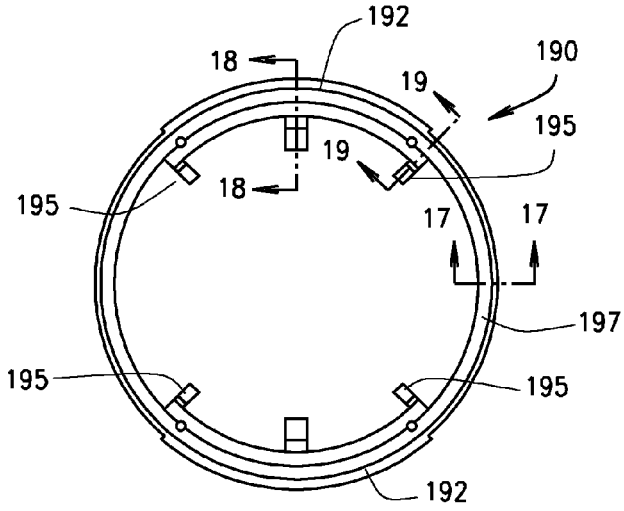
FIG. 14 is a top view of the support member.

As shown in FIGS. 8 and 9, the housing 170 includes an inner circular portion 172 and an outer circular portion 176. The support member 190 is positioned in-between the inner circular portion 172 and the outer circular portion 176. In this embodiment, the support member 190 is generally circular.

Figure 15:
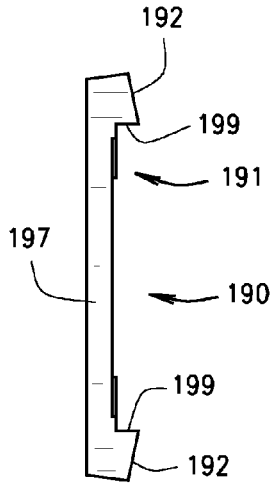
FIG. 15 is a side view of the support member.
Figure 16:
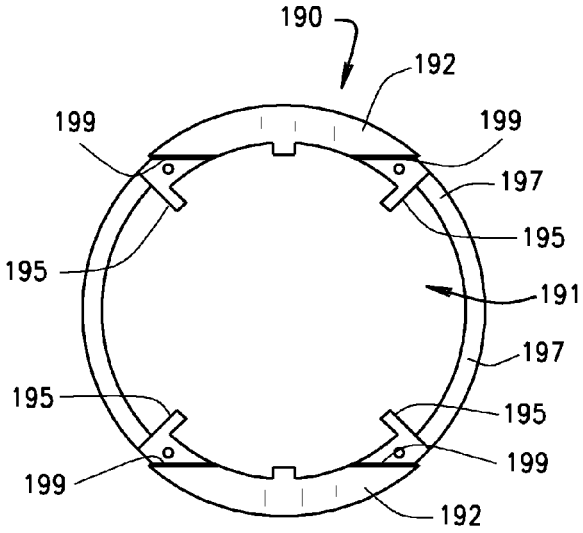
FIG. 16 is a bottom view of the support member.
Figure 17:
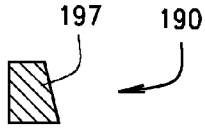
FIG. 17 is a sectional view of the support member at the thin portion.
Figure 18:
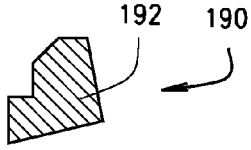
FIG. 18 is a sectional view of the support member at the descending portion.
Figure 19:
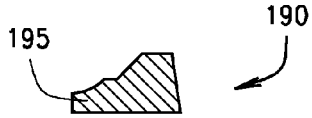
FIG. 19 is a sectional view of the support member at the tab.

The support member 190 also forms a channel 191 to assist in allowing the bistable spring 110 to coil. As shown in FIGS. 15 and 16, the channel 191 is partially formed by a descending portion 192 of the support member 190. The descending portion 192 includes walls 199 vertically disposed to a thin portion 197 of the support member 190. The walls 199 form a surface parallel to the length of the bistable spring 100. The combination of the channel 191 and support provided by the thin portion 197 provide for the bistable spring 110 to hinge against the housing 170. Tabs 195 of the support member 190 further support the support member 190.

Supports 174 extend from an upper surface 153 of a central portion 135 of the band 130. The supports 174 support the watch module 120 and maintain the watch module 120 above the upper surface 153 of the central portion 135. The space provided above the upper surface 153 of the central portion 135 defines a lower cavity 196. The lower cavity 196 is below the upper cavity 193. During the coiling or wrapping of the band 130, the central portion 135 of the band 130 flexes or bends in an upward manner toward the bottom surface 128 of the watch module 120. The lower cavity 196 provides a space for the central portion 135 to bend and deform without the central portion 135 pushing the watch module 120 from the housing 170. Further, the lower cavity 196 provides space for the central portion 135 to bend that does not deform the housing 170.

The housing 170 includes vertical walls 180 that rise from a base 182. The vertical walls 180 transition at a corner 184 into a rim 186 that defines the opening 171. The rim 186 extends towards a center of the housing 170. The watch module 120 is passed into the upper cavity 193 by stretching or widening the rim 186 of the housing 170. The elastic and resilient nature of the outer layer 115 causes the rim 186 to hold the watch module 120 in the upper cavity 193 of the housing 170. A lower surface 187 of the rim 186 urges against or maintains a rim 121 of the watch module 120. As such, the watch module 120 is securely held in the upper cavity 193 of the housing 170. However, the watch module 120 may be removed from the upper cavity 193 by pulling on the watch module 120 and causing the housing 170 to deform as the rim 186 is widened or enlarged in order to withdraw the watch module 120.

The band 130 transforms from the extended configuration 102 to the coiled configuration 104, which holds the first watch 100 to the wrist, arm, or other limb of the wearer. Both the first end 134 and the second end 144 wrap or coil to the wearer. The band 130 includes a first hinging portion 138 and second hinging portion 148 that hinge against the base 182 of the housing 170. This hinging engagement allows the band 130 to transform to the coiled configuration 104 without deforming or destabilizing the housing 170. The rigidity provided by the support member 190 and the base 182 provide for the first end 134 and the second end 144 to properly coil or wrap into the coiled configuration 104.

The central portion 135 is positioned within the housing 170. The central portion 135 includes the upper surface 153 that is directly below the watch module 120. On the opposite side of the band 130, the lower surface 163 of the central portion 135 is provided. The lower surface 163 may have a generally circular shape or widen substantially in order to form a bottom of the housing 170.

The lower surface of the band 130 may include a first relief element 161 and a second relief element 165. In the embodiment shown in the FIG. 7, the first relief element 161 and the second relief element 165 are scores or channels that are cut or formed into the lower surface 160 of the band 130. The first relief element 161 and the second relief element 165 may include generally parallel indentations in the lower surface 163. The first relief element 161 and the second relief element 165 may be formed parallel to the length of the bistable spring 110. The first relief element 161 and the second relief element 165 may be formed in the lower surface 163 outside of a width of the bistable spring 110. The first relief element 161 and the second relief element 165 provide for the watch 100 to transform from the extended configuration 102 and to the coiled configuration without substantially deforming or warping the housing 170, which could provide a poor aesthetic appearance to the watch 100.

The band 130 may have a length from the first end 134 to the second end 144 of approximately six inches to approximately sixteen inches or shorter or longer depending upon the application or intended use of the band 130. The length of the band 130 may be determined by the size of the wrist, arm, or other limb of the intended wearer. Adult versions of the first watch 100 may be longer, while child versions of the first watch 100 may be shorter in length. The adult versions may have a length of approximately eleven inches, while the child versions of the first watch 100 may have a length of approximately eight and a half inches. The width of the band 130 may range from approximately ⅜ inches up to approximately two inches. The width of the band 130 will vary depending on the size of the arm, wrist, or other limb of the intended wearer.

Several methods of manufacturing the first watch 100 will now be described. Molding techniques may be used to apply the outer layer 115 to the bistable spring 110. The band 130 is formed by coating a length of the bistable spring 110 with the outer layer 115. For example, silicone may be molded around the bistable spring 110. Generally, a single length of bistable spring 110 will be used in forming the band 130.

Figure 7:
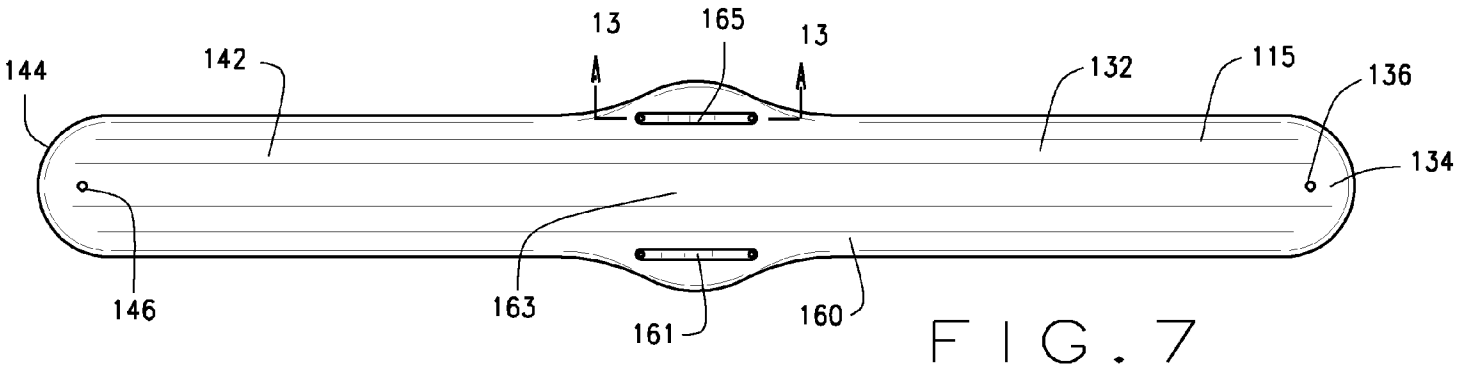
FIG. 7 is a rear view of the first watch.

The first watch 100 may be formed by casting solid silicone with molds. A first length of silicone is placed into the mold. The bistable spring 110 is placed in the mold on top of the first length of silicone. The bistable spring 110 is temporarily attached to the mold to fix a position of the bistable spring 110 in the mold. The bistable spring 110 may include one or more holes that are used to fixate or hold the bistable spring 110 in the mold or during the molding process. As shown in FIG. 7, the first end 134 include a first hole 136, while the second end 144 include a second hole 146. Pins, clamps, or other temporary holding implements temporarily fix or attach to the first hole 136 and to the second hole 146. For example, the pins may pass through the first hole 136 and the second hole 146. The pins hold the bistable spring 110 stationary relative to the mold. A second length of silicone is placed on top of the bistable spring 110. Heat and pressure are applied to the first length of silicone, the bistable spring 110, and the second length of silicone.

This provides a more uniform and consistent outer layer 115. Without using the registration process, the bistable spring 110 may be off-center or misaligned in the mold, which results in outer layer 115 that may be too thick or too thin in places or otherwise not centered on the bistable spring 110. This results in a sloppy product that may be rejected by quality control.

The first watch may also be made through injection molding. The bistable spring 110 is placed in the mold. The bistable spring 110 is temporarily attached to the mold to fix a position of the bistable spring 110 in the mold via the pins, clamps, or other temporary holding implements temporarily fix or attach to the first hole 136 and to the second hole 146. Liquid silicone may be injected or poured around the bistable spring 110. This provides accurate registration of the bistable spring 110 with the mold.

The registration processes described above also allows for an outer layer 115 to be accurately and repeatedly formed that is thinner than pre-existing designs. The outer layer 115 may have a thickness over the bistable spring 110 of approximately 0.7 mm to approximately 1.3 mm. The bistable spring 110 may have a thickness of approximately 0.08 mm to approximately 0.25 mm. The bistable spring 110 shown in the FIGS. has a thickness of approximately 0.16 mm. The bistable spring 110 is generally positioned in the middle of the band 130. The band 130 may have a total thickness of approximately 1.0 mm to approximately 3.0 mm. The total of thickness of the band 130 shown in the FIGS. is approximately is 2.2 mm. In other aspects, the band 130 and the bistable spring 110 may have larger or smaller dimensions depending upon the intended style, the intended user, materials, etc.

Figures 20, 21, 22:
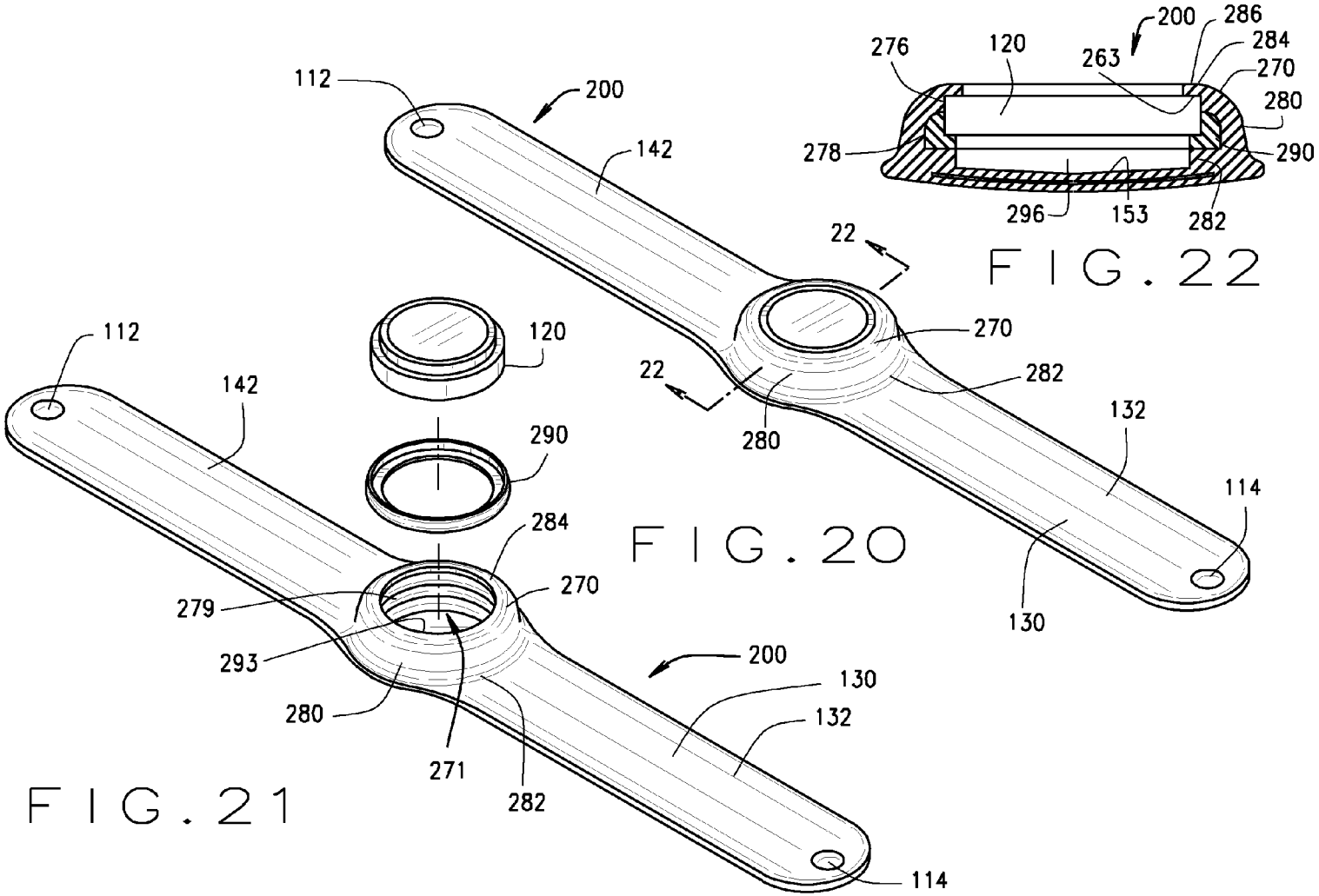
FIG. 20 is a perspective view of the second watch.
FIG. 21 is an exploded view of the second watch.
FIG. 22 is a sectional view of the second watch.
Figure 23:
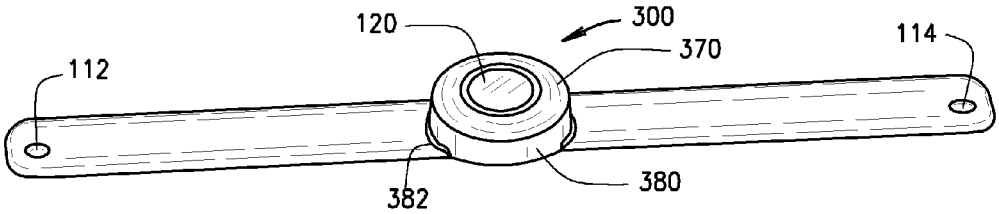
FIG. 23 is a perspective view of the third watch.
Figure 24:
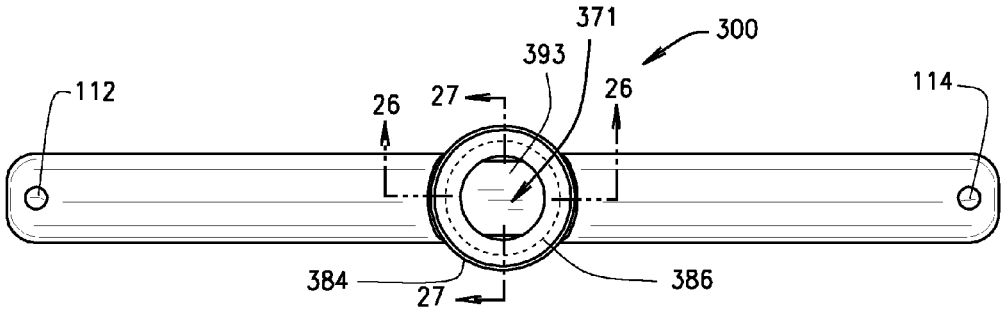
FIG. 24 is a top view of the third watch.
Figure 25:
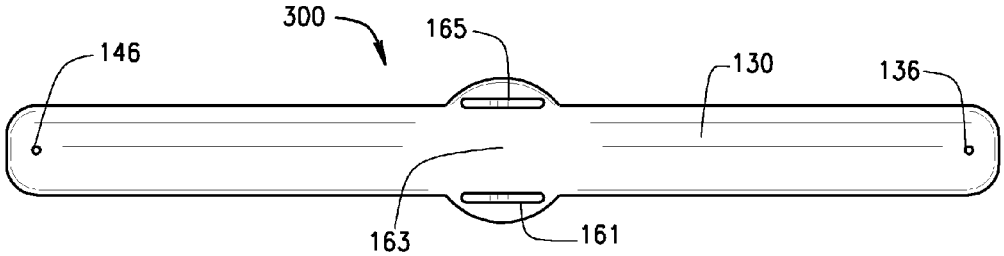
FIG. 25 is a rear view of the third watch.
Figure 26:
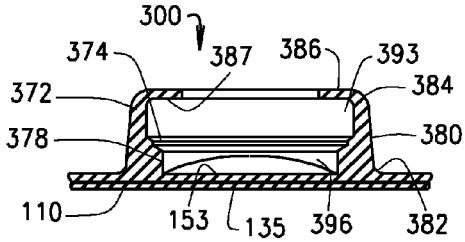
FIG. 26 is a sectional view of the third watch.
Figure 27:
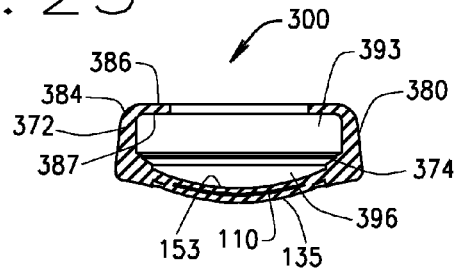
FIG. 27 is a sectional view of the third watch.

A second watch 200 will now be described with reference to FIGS. 20-21. The second watch 200 includes the band 130. The second watch 200 includes a housing 270. The housing 270 includes a support member 290 that is pressed in or glued into an interior of the housing 270. The support member 290 may be made of a rigid plastic material, such as nylon. The support member 290 may also be made of metal or other coated metal products. The housing 270 includes a vertical wall 280 that extends from a base 282. The vertical wall 280 transitions into a corner 284 and further into a rim 286 that defines an opening 271. The rim 286 includes a lower surface 263 that holds the watch module 120, similar to the first watch 100.

The housing 270 forms a first inner diameter 276 and a second inner diameter 278. The second inner diameter 278 surrounds the exterior of the support member 290. As such, the second inner diameter 278 is slightly larger than an outer diameter of the support member 290. Supports 282 extend from the upper surface 153 of the central portion 135. The supports 282 may be separate from or integral with the second inner diameter 278. The supports 282 support the watch module 120 when the watch module 120 is placed in the upper cavity 293 of the housing 270. The supports 282 hold and support the support member 290 above the lower cavity 296.

The first inner diameter 276 is slightly smaller than the second inner diameter 278 to form a groove 279 beneath the first inner diameter 276. The support member 290 may be held or affixed by an adhesive in the groove 279. As with the first watch 100, the lower cavity 296 of the second watch 200 provides space or an area for the central portion 135 of the band 130 to bend and flex without pressing against the watch module 120 with sufficient force to either eject the watch module 120 from the housing 270 or otherwise deform the housing 270.

The third watch 300 is shown with reference to FIGS. 23-27. The third watch 300 includes a housing 370 integral with the band 130. A lower cavity 396 provides space for the central portion 135 of the band 130 to bend and flex. An inner circular portion 372 surrounds the upper cavity 393. The inner circular portion 372 contacts the lateral surfaces 126 of the watch module 120. The bottom surface 128 of the watch module 120 rests upon a support surface 374 that separates the upper cavity 393 from the lower cavity 396. A vertical wall 378 rises from the upper surface 153 to join and form the support surface 374.

The exterior of the housing 370 is similar to the other watches 100 and 200 described herein. The housing 370 includes a vertical wall 380 extending from a base 382. The vertical wall 380 transitions at a corner 384 into a rim 386 that defines an opening 371. The rim 386 includes a lower surface 387 to hold against an upper surface 122 of the watch module 120.

Those skilled in the art will appreciate that variations from the specific embodiments disclosed above are contemplated by the invention. The invention should not be restricted to the above embodiments, but should be measured by the following claims.

What is claimed is:

1. A watch, comprising:

a band comprising a bistable spring, wherein the band includes an extended configuration and a coiled configuration;

the band forming a first portion and a second portion;

an outer layer that covers at least a portion of the bistable spring;

a watch module to display time data;

a housing that receives the watch module, wherein the housing is integral with the outer layer; and, the housing positioned between the first portion and the second portion of the band.

2. The watch according to claim 1, wherein the housing forms an upper cavity and a lower cavity, wherein the upper cavity holds or maintains the watch module, and the lower cavity provides a space for a central portion of the bistable spring to bend or flex.

3. The watch according to claim 1, wherein the outer layer comprises silicone, and the outer layer covers approximately the entire bistable spring.

4. The watch according to claim 1, wherein the housing forms an upper cavity and a lower cavity, wherein the upper cavity holds or maintains the watch module, and the lower cavity provides a space for a central portion of the bistable spring to bend or flex without the central portion contacting a lower surface of the watch module.

5. The watch according to claim 1, wherein an outer layer of silicone is molded around the bistable spring, the outer layer of silicone forms the housing, and the housing is resilient and deformable to receive and hold the watch module in a cavity of the housing.

6. The watch according to claim 5, wherein the housing defines an opening, and the opening is in open communication with the cavity, wherein the opening stretches or expands to receive the watch module.

7. The watch according to claim 1, wherein an outer layer of silicone covers the bistable spring, and the housing is integral with the outer layer.

8. The watch according to claim 1, wherein the housing comprises a support member.

9. The watch according to claim 8, wherein the support member is embedded in the housing, and the support member is made of a rigid material.

10. The watch according to claim 8, wherein the support member is positioned in-between an inner circular portion and an outer circular portion.

11. The watch according to claim 8, wherein the support member is glued or affixed to an interior of the housing.

12. The watch according to claim 8, wherein the support member includes a descending portion with walls generally vertically disposed to a thin portion of the support member, and the walls form a surface generally parallel to the length of the bistable spring, and the walls define a channel.

13. The watch according to claim 1, wherein the band includes the first portion and the second portion, wherein the first portion and the second portion are oppositely disposed to a central portion, wherein a lower surface of the central portion includes at least one relief element.

14. The watch according to claim 1, wherein a lower surface of the band includes a first relief element and a second relief element aligned parallel with the band.

15. The watch according to claim 1, wherein the housing and the outer layer are formed from the same material, and the housing is integral with the outer layer.

16. The watch according to claim 1, wherein the housing forms an upper cavity and a lower cavity, and a support surface for the watch module separates the upper cavity from the lower cavity.

17. The watch according to claim 1, wherein supports extend from an upper surface of a central portion of the band.

18. The watch according to claim 17, wherein the supports support the watch module and maintain the watch module above the upper surface of the central portion.

19. A band to hold an electronic device, comprising:

a band comprising a bistable spring;

the band forming a first portion and a second portion;

an outer layer that covers at least a portion of the bistable spring;

a housing to receive an electronic device, wherein the housing is integral with the outer layer;

the housing is positioned between the first portion and the second portion of the band;

the housing forms an upper cavity and a lower cavity; and, the upper cavity comprising a deformable or resilient opening.

20. A method of manufacturing a watch, comprising:

providing a bistable spring;

molding an outer layer and a housing around the bistable spring to cover at least a portion of the bistable spring, wherein the housing is integral with the outer layer; the housing comprising a cavity that receives a watch module;

deforming an opening of the housing to insert the watch module into the cavity; and, inserting the watch module into the cavity of the housing.

* * * * *